United States Patent [19]

Lerman

[11] Patent Number: 4,971,042

[45] Date of Patent: Nov. 20, 1990

[54] CARDIAC ASSIST CURIASS

[76] Inventor: Samuel I. Lerman, 8552 Canton Center Rd., Canton, Mich. 48187

[21] Appl. No.: 425,739

[22] Filed: Oct. 23, 1989

Related U.S. Application Data

[63] Continuation of Ser. No. 271,585, Nov. 14, 1988, Pat. No. 4,881,527.

[51] Int. Cl.[5] ..... A61H 31/02

[52] U.S. Cl. ..... 128/30.2; 128/30

[58] Field of Search ..... 128/30, 30.2, 28

[56] References Cited

U.S. PATENT DOCUMENTS

| | | | |
|---|---|---|---|
| 2,227,847 | 1/1941 | Shoolman | 128/30.2 |
| 2,581,893 | 1/1952 | Wilm . | |
| 2,780,222 | 2/1957 | Polzin et al. | 128/30.2 |
| 2,899,955 | 8/1959 | Huxley | 128/30.2 |
| 3,078,842 | 2/1963 | Gray . | |
| 3,368,550 | 2/1968 | Glascock . | |
| 3,610,237 | 10/1971 | Barkalow et al. . | |
| 4,003,371 | 1/1977 | Fischer | 128/30.2 |
| 4,182,317 | 1/1980 | Ash | 128/28 |
| 4,257,407 | 3/1981 | Macchi | 128/30.2 |
| 4,317,469 | 3/1982 | Pauliukouis | 137/625.65 |
| 4,338,924 | 7/1982 | Bloom | 128/28 |
| 4,349,015 | 9/1982 | Alferness | 128/28 |
| 4,397,306 | 8/1983 | Weisfeldt et al. | 128/28 |
| 4,424,806 | 1/1984 | Newman | 128/28 |
| 4,664,098 | 5/1987 | Woudenberg et al. | 128/28 |
| 4,840,167 | 1/1989 | Olsson et al. | 128/30.2 |

FOREIGN PATENT DOCUMENTS

| | | | |
|---|---|---|---|
| 365919 | 1/1963 | Switzerland | 137/625.65 |

OTHER PUBLICATIONS

*Cardiomedics,* Inc., Brochures.

*Emerson,* Brochures, J. H. Emerson Co., Cambridge, Mass.

*Cardiassist,* Brochures, Cardiassist Corp., 1980.

Rudolph Eisenmenger, Article w/translation, Oct. 1942.

*Pressure Boot,* Medical World News, 12/8/72.

*Hemodynamic Effects,* American Journal of Cardiology, 1974.

*Clinical Assessment,* American Journal of Cardiology, 1980.

*Clinical Assessment of Sequential External Counterpulsation.*

*Effects of Pulsed External Augmentation,* American Heart Journal, 1985.

*External Counterpulsation,* JAMA, 9/9/74.

*Negative Pressure Artifical respiration,* Canadian Medical Association Journal, 3/28/70.

*Primary Examiner*—Richard J. Apley

*Assistant Examiner*—Jennifer L. Doyle

*Attorney, Agent, or Firm*—Harness, Dickey & Pierce

[57] ABSTRACT

A cardiac assist cuirass is disclosed that acts to alternately apply compression and vacuum to the torso of a patient. This draws venous blood back from the periphery into the lungs and forces oxygenated blood out from the lungs through the left heart to the rest of the body, while at the same time ventilating the lungs. Thus, it can maintain life even during complete cardio-pulmonary arrest. It can also be synchronized with a weakly beating heart for assistance in congestive heart failure or cardiogenic shock. It is adjustable for a wide range of body sizes, does not interfere with routine nursing care or intensive medical care. It is hand portable, uses standard electric supply and is easily adjustable for a wide range of cardiac and pulmonary purposes.

3 Claims, 2 Drawing Sheets

CARDIAC ASSIST CURIASS

This is a continuation of copending application Ser. No. 07/271,585, filed Nov. 14, 1988, now U.S. Pat. No. 4,881,527.

BACKGROUND OF THE INVENTION

This invention in general relates to a counterpulsation device that assists the pumping action of the heart and also increases the supply of blood to the heart muscle. Cardio-pulmonary resuscitation as now being taught for cardiac arrest, requires rhythmic compression of the chest with less frequent ventilation of the lungs by mouth to mouth breathing. One recent resuscitation device consists of a pneumatic garment that is rhythmically inflated to compress the torso while a tube in the windpipe periodically inflates the lungs. Though this provides excellent circulation of blood to the periphery during compression, there is inadequate circulation of blood to those organs within the zone of compression, including the heart muscle itself, which gets only slight perfusion during the diastolic period between chest compressions. This device may also be synchronized with a weakly bearing heart to provide cardiac assistance.

Another group of cardiac assist devices work by counterpulsation. The first of these is the intra-aortic balloon pump. Its balloon is deflated during systole so as to drop the pressure in the aorta against which the heart pumps and reinflated during diastole (between heart beats) so as to raise the diastolic pressure which perfuses the heart muscle. Complications of this device include blood clots, bleeding, infection and sometimes loss of a leg. Therefore non-invasive counterpulsation devices have been developed which achieve the same effect by abrupt compression of the extremities so as to squeeze arterial blood back into the aorta during cardiac diastole then abruptly releasing the compression so as to drop the systolic aortic pressure against which the weakened heart ejects blood. Counterpulsation devices are of course useless during cardiac arrest.

Combining compression of the torso during cardiac systole with compression of the extremities during cardiac diastole has been proposed by some researchers, though such a device is not commercially available.

It is an object of this invention to provide a simple device that substitutes a vacuum around the torso for compression of the extremities. Thus, during cardiac arrest the negative pressure will draw venous blood into the lungs and the compression will pump oxygenated blood to the periphery. If synchronized with the weakly beating heart it will provide the same assistance as the combination of the two above devices, but in a much simpler, more compact and easier-to-apply form. It also ventilates the lungs without the need of an endotracheal tube.

SUMMARY OF THE INVENTION

The present invention discloses a cardiac assist cuirass that can be adapted to fit any individual's body shape and also is controllable at any cyclic rate and which may be a speed that approximates the heartbeat and at any pressure up to one that approximates the highest blood pressure commonly encountered.

The cardiac assist cuirass of the present invention achieves its goals by providing a two-part housing shell that includes a first bottom shell portion into which a second upper shell portion fits, the two shell portions have semi-flexible side sections that can bend outwardly to accommodate various-shaped bodies. The upper and bottom shells are fastened together around the patients torso, either by stapling them together, or by fastener strips on their sides that permit adjustment for the size of the enclosed body. A belt wraps around the entire shell portion and mounts the control and power section directly on top of the upper shell portion. At all outer edges of the upper shell portion there is provided a sealing lining that acts to define and seal a chamber within the upper shell against a patient's chest so that air will not leak out between the shell and the torso. The shell fits below the armpits and above the pubic or hip region so that access to the bladder, bowel and intravenous lines will not be blocked. In addition, a diaphragm member is connected to the inside of the upper shell in a position such that it will contact the patient's chest and act to further define and seal the chamber within the upper shell portion. The diaphragm and the chamber that it defines are alternately expanded and contracted in order to squeeze and expand the patient's lungs by a control and power unit that comprises a four-way solenoid valve. The power unit includes a blower that draws air into an inlet and blows out high-pressure air from an outlet. The four-way solenoid valve alternately connects the inlet and outlet to the chamber in order to provide alternating positive and negative pressures within the chamber. A control unit controls the solenoid valve actuation and may be synchronized with the heartbeat by monitoring the patient's ECG signals. Sometimes it may be preferable to expand the lungs slowly and squeeze them quickly thus clearing phlegm or other materials from the air passages. In addition, the blower is selected so that it can develop a pressure high enough that the squeezing force on the chest caused by pressure in the chamber will exceed blood pressure. Relief valves are disposed in the shell that can be adjusted to finely, and separately control the pressure and vacuum to any desired levels.

In addition, the present invention includes a mask that fits over the patient's mouth in order to limit the amount of air that can come into his lungs. This is necessary due to the high expansion pressures that will be exerted upon his lungs. If it were not for the mask, the expansion of the lungs will draw in far too much air than is necessary and might rupture the lungs. During the squeezing of the lungs, the burst of high pressure that will flow up through the patient's windpipe can act to remove phlegm or other materials from the throat, and thus suctioning may not be necessary. Any other method of restriction of air intake may be used in place of the mask.

It is an object of the present invention to provide a cardiac assist cuirass with a shell that can conform to various body shapes and yet still seal against the body well enough that the internal shell will retain an air pressure that approximates that of blood pressure to squeeze a patient's lungs so that they act as a pump to supplement the heart.

It is further an object of the present invention to disclose a cuirass in which the power and control unit are mounted directly on top of the shell so that there is no dead space between the control unit and the shell, and the control unit can cycle quite quickly and have almost instantaneous response to the control unit signals to shift from vacuum expansion to pressure contraction.

The rigid shell supports the power unit so that no weight rests on the patient's body.

These and other features of the present invention can be best understood upon a consideration of the following specification and drawings.

BRIEF DESCRIPTION OF THE DRAWINGS p

DETAILED DESCRIPTION OF THE PREFERRED EMBODIMENT

Figure 1:
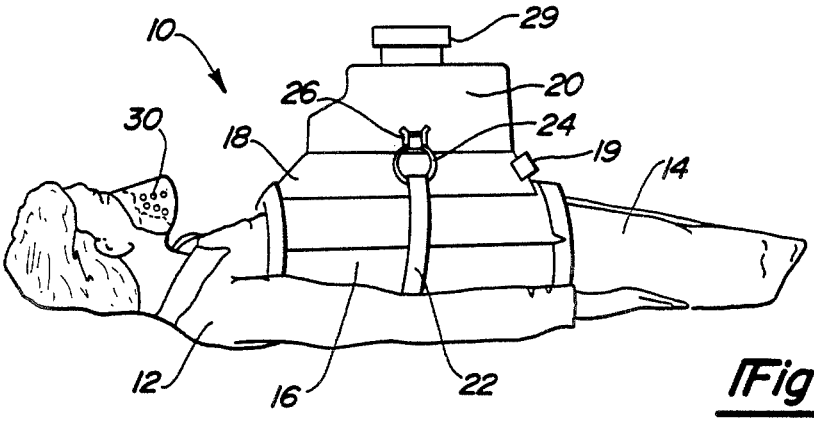
FIG. 1 is a side view showing the cardiac assist cuirass of the present invention mounted on a patient.

Referring now to FIG. 1, the cardiac assist cuirass 10 of the present invention will be described. The device consists of a lower shell portion 16 that overlaps an upper shell portion 18 to provide a cover for the torso 12 of a patient. As can be seen in FIG. 1, the shell portions end above the hips 14 of the patient so that the patient's urinary and excretory functions will not be impeded. That is, there is excess to the bowels, bladder and all the usual intravenous and intra-arterial sites. Also the shell fits beneath the arm pits so that the patient's arm are free to move. A pressure gauge 19 is mounted upon the upper shell portion 18 so that the pressure within the shell portion can be monitored. A power and control section 20 is mounted directly on top of the upper shell portion 18, and a belt extends underneath the patient and wraps over the lower shell portion 18 and up around the upper shell portion. Hook members 24 extend laterally out of the control and power section 20 and are snapped into guide members 26 formed on the upper shell portion. The belt 22 has rings at each end thereof, and these rings are attached to the hooks 24 that extend from the power and control section 20. As can be best seen in FIGS. 4 and 5, a flange 27 extends downwardly from the power and control section 20 and will be inserted in an opening or port 28 formed in the upper shell portion. The combination of the belt 22 and the insertion of the flange 27 into the opening or port 28 will fixedly secure the power and control section 20 upon the upper shell section 18. If the belt 22 is tight enough the flange 27 may not be necessary. A handle member 29 aids in carrying and mounting of the power and control section 20.

A mask 30 fits over the patient's mouth in order to limit the amount of air that can come into his lungs. This is necessary due to the high expansion pressures that will be exerted upon his lungs. If it were not for the mask 30, the expansion of the lungs will draw in far too much air than is necessary and might rupture the lungs. During the squeezing of the lungs, the burst of high pressure that will flow up through the patient's windpipe can act to remove phlegm or other material from the throat, and thus suctioning may not be necessary. Any other method of restriction of air intake may be used in place of the mask 30.

Figure 2:
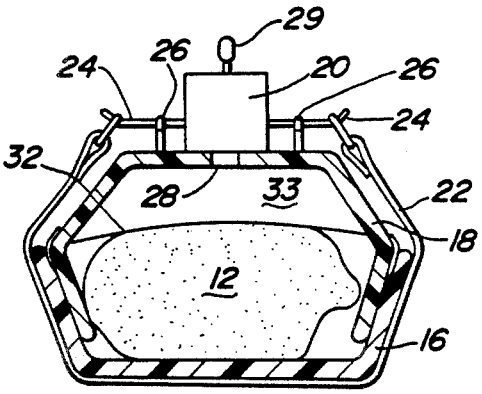
FIG. 2 is a cross-section through the chest of a patient with the cardiac assist cuirass of the present invention mounted thereon.

As can be seen from FIG. 2, the cardiac assist cuirass 10 of the present invention consists of a two-part shell that will accommodate various size bodies, as will be explained later and also acts to form a tightly sealed chamber around a patient'torso. A diaphragm 32 is secured to the inside of the upper shell portion and forms a sealed chamber 33 between the top of the upper shell portion and the diaphragm 32. A central hole in the diaphragm seals against the patient's skin during compression, and avoids blocking the port 28 during suction.

Figure 3:
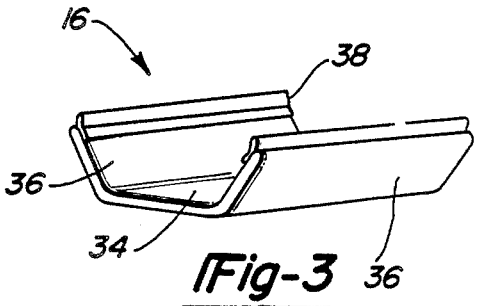
FIG. 3 is a perspective view showing the bottom shell portion of the cardiac assist cuirass of the present invention.

As seen in FIG. 3, the bottom shell 16 includes a bottom portion 34 that is shaped to correspond to an individual's back and that curves into two upwardly extending side portions 36. Each side portion 36 can fasten to the upper shell 18 in adjustable positions corresponding to the size of the patient's torso. A strip of tape 38 or similar product can be used to secure the side portion to upper shell. Alternatively, that can be stapled together, with two staples 120 on each side.

Figure 4:
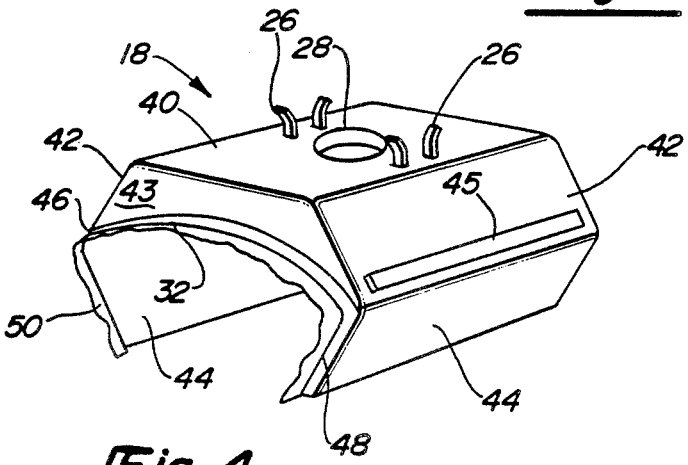
FIG. 4 is a perspective view showing the top shell portion of the cardiac assist cuirass of the present invention.

FIG. 4 shows the top shell portion of the cardiac assist cuirass 10. As can be seen, the top shell portion includes a top wall 40 and twin outwardly and downwardly extending side portions 42. Portions 44 extend downwardly from the side portion 42 and are formed of a semi-flexible material so that they will bend outwardly to accommodate a larger patient. Diaphragm 32 can be seen as being mounted within the upper shell 18 to the side walls 42 and the front and rear walls 43. The side portions 42 are intended to be secured in adjustable position to the lower shell portion 16. A strip of adhesive tape 45 can be used or the shells may be stapled together. Outwardly extending flange lip members 46 and 48 may have sealing material 50 mounted thereto and act to provide a tight seal against leakage of air into the interior of the upper shell portion 18 during the suction phase. Altlernatively, a latex sheet may be secured over the shell edges at both the head and foot each ends of the shells, and to seal the overlap of top and bottom shells.

Figure 5:
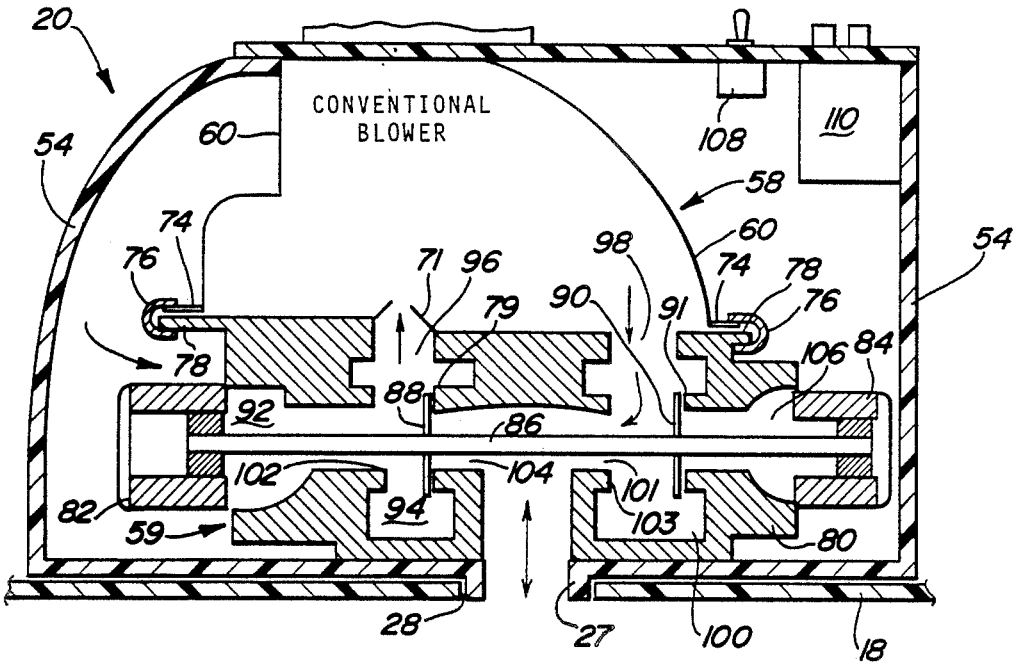
FIG. 5 is a cross-section through the control and power unit of the cardiac assist cuirass of the present invention.

With reference now to FIG. 5, the power and control unit 20 will be described. The power control unit 20 is mounted to the upper shell portion 18 by the insertion of the downwardly extending flange portion 27 into the opening or port 28 formed on the upper shell portion 18. The power and control portion 20 consists of an outer housing member 54 that is formed of a plastic and acts to deaden any sounds that come from the power and control unit 20. A plate 56 defines the top of the housing of the power and control unit 20 and also acts to support the handle and various controls. A blower assembly 58 and a valve assembly 59 are disposed within the housing. Blower 58 is mounted within the power and control unit 20 and acts to provide the high pressure and vacuum that compress and expand the chest of the patient. The blower is an off the shelf vacuum motor enclosed in an outer housing 60 and has an inlet port 71. The clamp 76 goes over the flange 74, and a similar flange 78 that is formed on the valve assembly 59. Valve assembly 59 consists of a valve body 80 with two opposed solenoids 82 and 84 that act to reciprocate a valve rod 86. The valve rod 86 has valve diaphragms 88 and 90 mounted upon it. It is to be understood that the valve body 80 would preferably not be a one piece item but would have end pieces that will be attached to a central piece for easier assembly.

The two opposed solenoids 82 and 84 are alternately energized to reciprocate the valve rod 86 and alternately connect pressure and suction to the chamber 33 within the upper cuirass shell. In the position shown in FIG. 5, the solenoid 82 is de-energized, and the solenoid 84 is energized and has moved the valve rod 86 to its right-most extent. In this position, the diaphragm valve member 88 is engaging a valve seat 89 formed on the valve body 80, and the diaphragm valve 90 is engaging a second valve seat 91, also formed on the valve body 80. While in this position, the fan blower acts to suck air from within the housing 54 into a chamber 92 that is formed between the valve body 80 and the valve rod 86. Air enters the chamber 92 through an opening in the mounting of solenoid 82 that are not illustrated. The air travels from the chamber 92 into an inlet plenum 94 formed in the valve housing and from there into a port 96 from which it enters the inlet 71 of the blower 58. The air is the pressurized by the fan 66, exits through the blower 58 and then enters port 98 formed within the valve body 80. From the post 98, the air travels into an inlet plenum 100 from which it flows through an opening 101 between the valve rod 86 and the valve body 80 through the tube opening 27 and into the upper shell of the cuirass and the chamber 33. The air entering the chamber 33 is at a high pressure and expands the diaphragm 32 to squeeze the torso 12 of the patient at a pressure exceeding the normal blood pressure of a human being. This pressure may be as high as 250 mm Hg. Upon the end of this squeezing stroke, the solenoid 84 is de-energized, the solenoid 82 is energized and the valve rod 86 is moved to the left. When the valve rod is at its left-most extent, the diaphragm member 88 engages a valve seat 102 formed in the valve body 80, and the diaphragm valve 90 engages another valve seat 103 formed in the valve body 80. With the valve in this position, air can no longer move from chamber 92 into the inlet plenum 94 since the valve 88 is resting on the seat 102. Instead, the air going into the fan inlet 71 comes through the tube 27 into a path 104 formed between the valve rod 86 and the valve housing and then into the inlet plenum 94, the port 96 and the fan inlet 71. In order to make this suction as rapid as possible, the valve body is designed so that the flow cross-section of any portion along this path is at least as great as the flow cross-section at the blower inlet. This eliminates any restrictiions in the flow. The air discharging from the fan can no longer enter the path 101 to get to the inside of the cuirass shell since the valve 90 is resting on valve seat 103. Instead, the air entering port 98 in the valve body 80 flows along a path 106 formed between the valve rod 86 and the valve body 80 and exits through gaps in the mounting of solenoid 84, not illustrated. This alternating flow between the fan and the interior of the curiass shell chamber 33 is illustrated by the double-pointed arrow in FIG. 5. Thus, the above controls the frequency and connection of pressure into the shell such that it approximates a patient's heartbeat. Also, it controls the pressure of discharge air entering the shell such that it approximates a patient's blood pressure.

Figure 6:
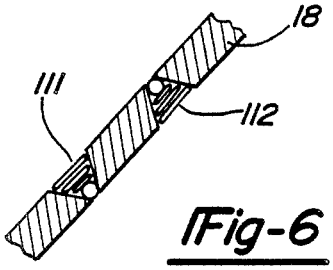
FIG. 6 is an enlarged cross-sectional view through a portion of the upper shell of the cardiac assist cuirass of the present invention showing the relief valves for regulation of pressure and vacuum.

Also shown in FIG. 5 is an on-off switch 108 that is mounted in the top plate 56 of the control and power unit 20 and timer assembly 110 that is also mounted on the top plate 56. The frequency of cycling of the blower 58 can be controlled by the timer mechanism 110. In addition, a control signal can be sent to the timer assembly 110 from an ECG machine that is monitoring the patient's heartbeat so that the alternating expansion and contraction of the patient's chest can be made to correspond to the patient's heartbeat. A conventional blower motor speed control, not shown, may be used to vary the pressures that the blower develops. An optimum fixed rate will be used if the patient's ECG readings are erratic. It may be preferable that the expansion be relatively slow and the contraction be relatively sudden so as to create a burst of outgoing air to clear the air passages of the patient. In addition, pressure relief valve 111 and vacuum relief valve 112, FIG. 6, can be used to prevent overly high or low pressure in the chamber 33 and provide independent control of these two variables. By adjusting the valve biasing springs the pressures at which these two valves open can be controlled. The openings for their valves should be quite large, at least on the order of the opening for the port 28.

It is to be understood that the cardiac assist curiass of the present invention not only assist the heart but also maintains ventilation despite weakness or paralysis of breathing muscles.

Figure 7:
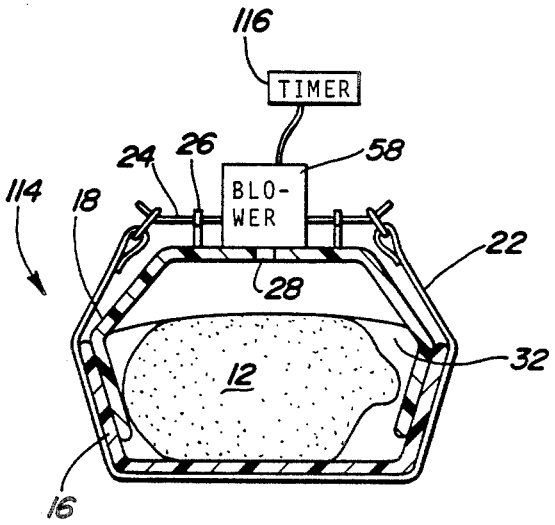
FIG. 7 is a simple negative pressure ventilator disclosed as a second embodiment of the invention.

A simple negative pressure ventilator is shown in FIG. 7 that aids in breathing is assembled by omitting the valve assembly and simply having the shell with a blower mounted directly on it. An on/off timer would control the duration of insperation and of passive experation, independently. The negative pressure ventilator 114 includes the blower 58 and the shell portion 16, 18 however, the vacuum motor is directly connected to the shell. The vacuum motor in its housing can be rapidly removed from the shell in case of motor failure and replaced in a matter of seconds. The blower 58 is controlled by an on/off timer 116 and a vacuum relief valve and vacuum gauge, not shown are also mounted in the shell.

A working embodiment of the present invention has been disclosed. However, a worker in the art would understand that certain modifications could be made without departing from the scope of the invention. For instance, the pressure and suction of the air could be provided by any type of pump or blower, and various other valve mechanisms could be used to achieve the alternating connection of suction and pressure to the cuirass shell. The intended scope of the present invention can be best understood upon consideration of the appended claims.

I claim:

1. A cardiac assist method comprising the steps of:

providing a chamber which is substantially sealed about a patient's torso for applying pressurized air and a vacuum upon the patient's torso for applying either pressure or a vacuum caused suction upon the patient's torso;

alternatingly applying pressurized air within the chamber and applying a vacuum within the chamber, by sucking air from the chamber, for alternate pressure squeezing and expansion of a patient's torso in response to the alternating applications of pressure and vacuum;

restricting the flow of air into the patient's body through the patient's mouth and nose by a passive restrictive means;

setting the frequency of alternating the application of pressure and vacuum in the chamber to closely approximate the rate of the patient's heartbeat and setting the pressure of the pressurized air entering into the chamber so that the chamber pressure approximates the patient's blood pressure.

2. A cardiac assist method as defined in claim 1, and wherein the pressure is applied in the chamber and upon the patient's torso during the time that corresponds to the patient's heart contraction so as to compress the torso during the time of the heart contraction, and the vacuum is applied during the time of the heart's expansion so that the torso is permitted to expand during the time of the heart expansion.

3. A cardiac assist apparatus comprising:

a chamber forming means shaped and sized to fit over the torso of the body of a patient and to define a chamber overlapping at least the chest and diaphragm regions of the torso, and including sealing means for substantially sealing the chamber against the torso so that changes in pressure within the chamber are applied to the patient's torso;

means for alternatingly pumping pressurized air into the chamber and for sucking air from the chamber for regularly, alternatingly applying a pressure and a vacuum within the chamber and against the torso;

means for timing the frequency of change of applying the pressurized air and the vacuum within the chamber to correspond to the rate of the patient's heartbeat with the pressure applied during the time of contraction of the heart and the vacuum applied during the time of expansion of the heart;

means for regulating the pressure of the pressurized air so that the chamber pressure approximately equals the patient's blood pressure; and means for passively restricting flow of air into a patient's body through a patient's mouth and nose.

* * * * *